US008142337B2

(12) United States Patent
Hall

(10) Patent No.: US 8,142,337 B2
(45) Date of Patent: Mar. 27, 2012

(54) EXERCISE POLE DEVICE

(76) Inventor: William B. Hall, Evanston, IL (US)

( * ) Notice: Subject to any disclaimer, the term of this patent is extended or adjusted under 35 U.S.C. 154(b) by 0 days.

(21) Appl. No.: 12/651,037

(22) Filed: Dec. 31, 2009

(65) Prior Publication Data

US 2010/0173760 A1 Jul. 8, 2010

Related U.S. Application Data

(60) Provisional application No. 61/142,358, filed on Jan. 4, 2009.

(51) Int. Cl.
*A63B 21/04* (2006.01)

(52) U.S. Cl. ..... 482/129; 482/904

(58) Field of Classification Search ..... 482/12, 482/72, 73, 121–130, 148, 904, 91, 139, 482/23, 39, 40, 908
See application file for complete search history.

(56) References Cited

U.S. PATENT DOCUMENTS 3,256,015 A * 6/1966 Perrin ..... 482/129
3,785,644 A * 1/1974 Bradley et al. ..... 482/127
4,059,265 A * 11/1977 Wieder et al. ..... 482/125
4,245,839 A 1/1981 Trent
4,477,073 A 10/1984 Koch et al.
4,560,160 A * 12/1985 Smith ..... 482/120
4,779,867 A * 10/1988 Hinds ..... 482/126
5,112,287 A * 5/1992 Brewer ..... 482/130
5,131,650 A * 7/1992 Hall ..... 482/126
5,190,512 A * 3/1993 Curran ..... 482/124
5,556,368 A * 9/1996 Akin ..... 482/124
5,601,518 A * 2/1997 Weintraub ..... 482/129
5,807,214 A * 9/1998 Riazi ..... 482/129
5,820,529 A 10/1998 Weintraub
6,348,026 B1 * 2/2002 Kuo ..... 482/126
6,592,474 B1 * 7/2003 Halsworth ..... 473/453
6,746,383 B2 * 6/2004 Yu ..... 482/127
6,979,286 B1 * 12/2005 Hinds ..... 482/121
7,217,227 B2 5/2007 Finn
7,322,908 B2 * 1/2008 DiGiacomo ..... 482/121
7,591,763 B1 * 9/2009 Fucci ..... 482/52
7,608,025 B1 * 10/2009 Best ..... 482/123
7,762,913 B1 * 7/2010 Hagen et al. ..... 473/457
7,918,773 B2 * 4/2011 Brennan et al. ..... 482/129
7,946,970 B2 * 5/2011 Garza et al. ..... 482/126
2002/0187885 A1 * 12/2002 Liao ..... 482/126
2003/0216220 A1 * 11/2003 Rota ..... 482/27
2005/0107226 A1 * 5/2005 Monda ..... 482/121
2005/0113220 A1 * 5/2005 Dovner et al. ..... 482/121
2005/0113223 A1 * 5/2005 Dovner et al. ..... 482/121
2005/0239617 A1 * 10/2005 Tenaglia ..... 482/122
2006/0052223 A1 * 3/2006 Terry ..... 482/126

(Continued)

OTHER PUBLICATIONS

SPRI Xercise Bar; SPRI Products, Inc.; <URL: http://http://www.spri.com/Item.aspx?ItemID=510>; retrieved on Apr. 17, 2010.
Ab Booty; Savvier, LP; <URL: http://www.abbooty.com/default.asp>; retrieved on Feb. 15, 2010.
Accelerator; Gaiam Americas, Inc.; <URL: http://www.winsorslim.com/drtv/ecs/pilates-system-features.html>; retrieved on Apr. 4, 2010.

(Continued)

*Primary Examiner* — Loan Thanh
*Assistant Examiner* — Daniel F Roland
(74) *Attorney, Agent, or Firm* — Andover Patents, LLC; Daniel N. Beinart

(57) ABSTRACT

A device for performing physical exercise includes a substantially rigid elongated pole, an elastic band comprising components for attaching the elastic band to the pole, and an anchor component for securing the elastic band to an external object.

19 Claims, 18 Drawing Sheets

U.S. PATENT DOCUMENTS

| | | | | |
|---|---|---|---|---|
| 2008/0020913 | A1* | 1/2008 | Wilson et al. | 482/139 |
| 2008/0096737 | A1* | 4/2008 | Ayoub | 482/107 |
| 2008/0280738 | A1* | 11/2008 | Brennan et al. | 482/129 |
| 2009/0239675 | A1* | 9/2009 | Wallace | 473/220 |
| 2009/0280965 | A1* | 11/2009 | Shapiro et al. | 482/72 |
| 2010/0126902 | A1* | 5/2010 | Garza et al. | 206/579 |

OTHER PUBLICATIONS

TRX Rip Trainer; Fitness Anywhere LLC; <URL:http://www.trxtraining.com/page/000-94127/PROD/TRXRIP-PACK? Category_Code=RIP>; retrieved on Aug. 20, 2011.

* cited by examiner

EXERCISE POLE DEVICE

CROSS-REFERENCED TO RELATED APPLICATIONS

This application claims priority to U.S. Provisional Application No. 61/142,358 filed Jan. 4, 2009, the entire contents of which are hereby incorporated by reference, as if fully set forth herein.

FIELD OF THE INVENTION

The present invention relates generally to the field of personal exercise devices, and more particularly to a portable exercise pole device.

BACKGROUND OF THE INVENTION

Existing personal exercise devices that permit the exercise or conditioning of different muscle groups are not sufficiently portable and easy to use in a variety of environments, such as the home, office or hotel.

Therefore a need exists for a device that permits the performance of physical exercises or conditioning maneuvers for a variety of different muscle groups that is sufficiently portable and easy to use at various locations.

A device constructed according to the principles of the present invention addresses these deficiencies.

BRIEF SUMMARY OF THE INVENTION

In accordance with principles of the present invention, an exercise pole device for performing physical exercise includes a substantially rigid elongated pole or bar, a length of resistance tubing or elastic cord or band comprising one or more components for attaching the resistance tubing to the pole, and an anchor component for attaching, securing or anchoring the resistance tubing to an external object, such as a door, doorframe or wall.

Other objects and features of the present invention will become apparent from the detailed description considered in connection with the accompanied drawings. It is to be understood however, that the drawings are designed as an illustration only and not as definition of the limits of the invention. It is obvious that many changes and modifications may be made thereunto without departing from the spirit and scope of the invention.

DETAILED DESCRIPTION OF THE INVENTION

Figure 1:
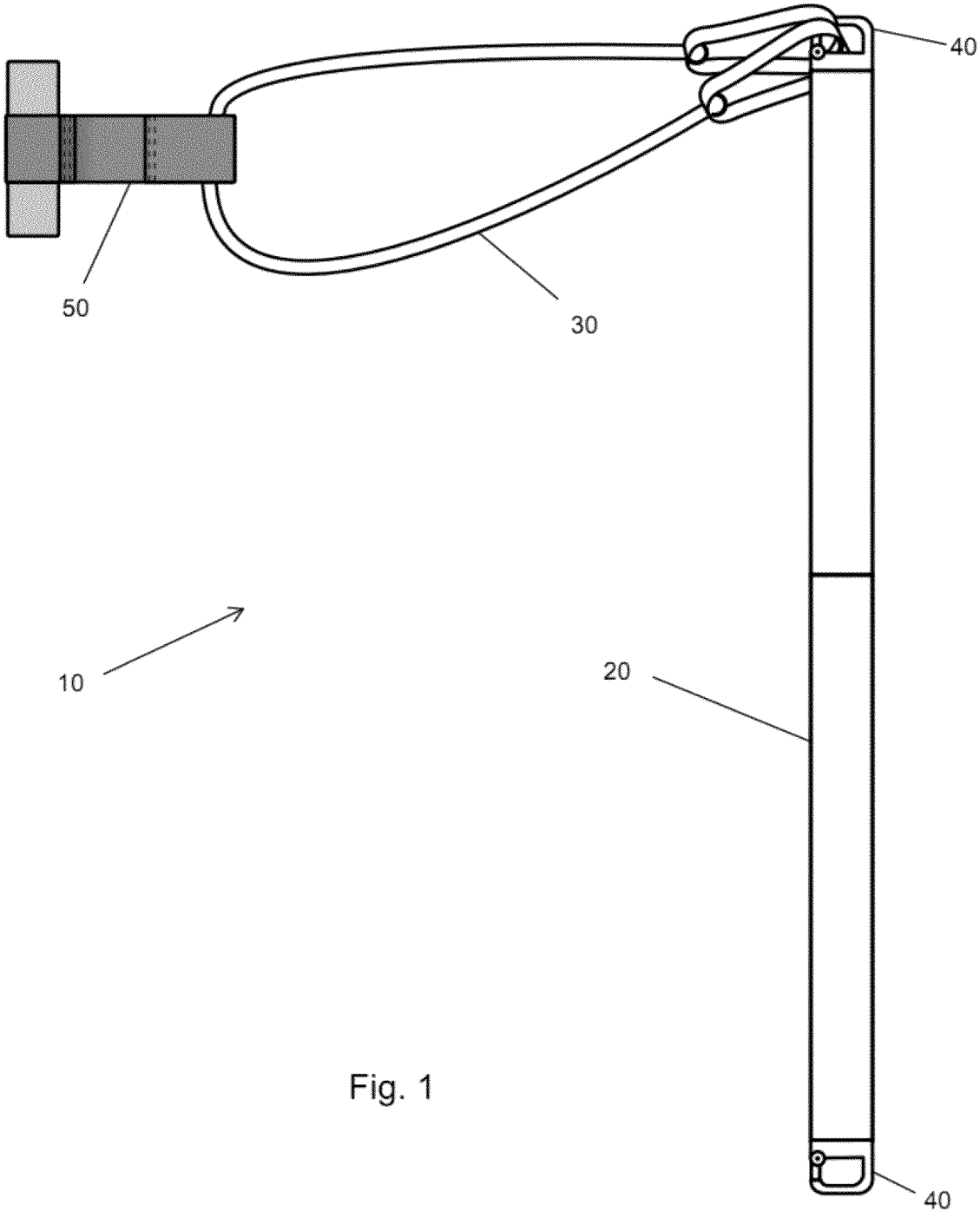
FIG. 1 depicts an embodiment of an exercise pole device in open-end configuration in accordance with principles of the present invention.
Figure 2:
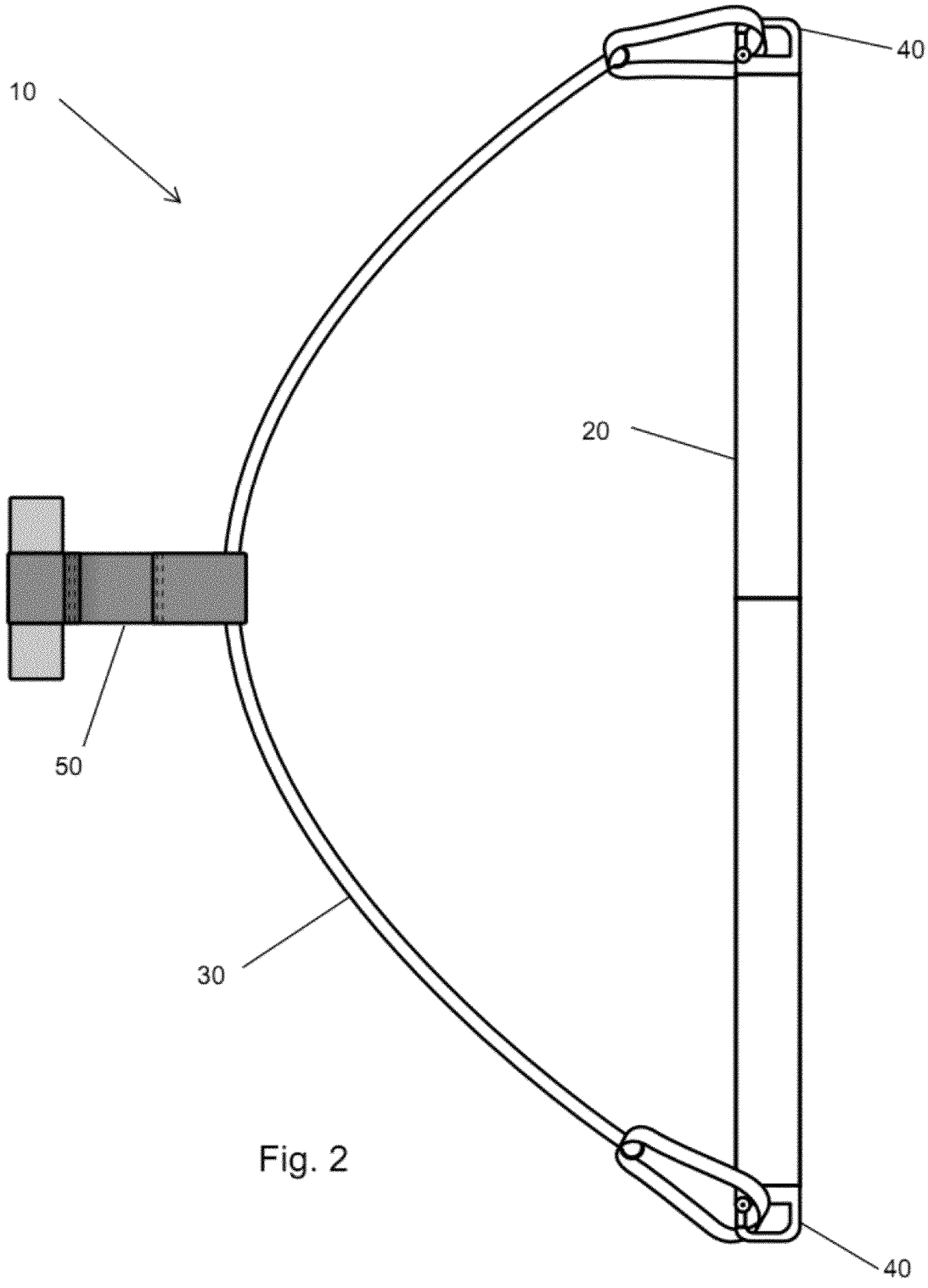
FIG. 2 depicts the exercise pole device of FIG. 1 in closed-end configuration in accordance with principles of the present invention.

FIGS. 1 and 2 depict an embodiment of an exercise pole device assembled in open-end and closed-end configurations, respectively, in accordance with principles of the present invention. As depicted in FIGS. 1 and 2, an exercise pole device 10 is comprised of a substantially rigid elongated pole or bar 20, a length of resistance tubing, elastic cord or elastic band 30 attached or secured to the pole 20, end components 40 disposed at each of the two ends of the pole 20 for attaching the resistance tubing 30 to the pole 20, and an anchor component 50 attached or secured to the resistance tubing 30 for attaching, securing or anchoring the exercise pole device 10 to an external object. FIG. 1 depicts the resistance tubing 30 attached to one end component 40 of the exercise pole device; FIG. 2 depicts the resistance tubing 30 attached to two end components 40 of the exercise pole device. One skilled in the art will recognize that an end component 40 may be an integral part of the pole 20.

An alternate embodiment (not shown) of the exercise pole device 10, to be assembled only in open-end configuration, comprises only a single end component 40, disposed at one of the two ends of the pole 20.

Figure 3:
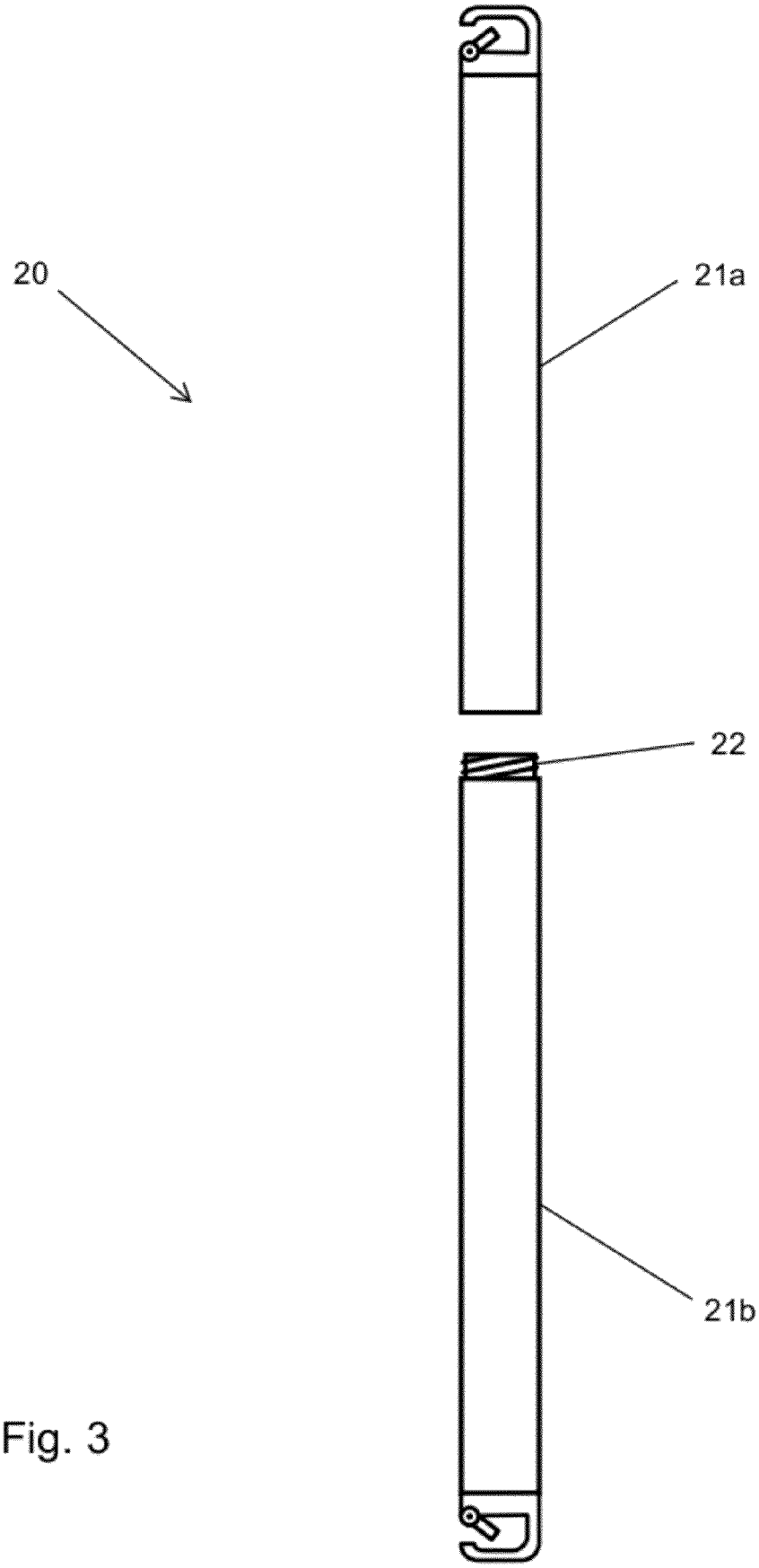
FIG. 3 depicts a pole component of the exercise pole device of FIG. 1 in accordance with principles of the present invention.

FIG. 3 depicts a disassembled pole component of the embodiment of the exercise pole device of FIG. 1 in accordance with principles of the present invention. As depicted in FIG. 3, a pole 20 is comprised of two pole segments 21*a* and 21*b*, which in the depicted embodiment have mating threads 22 for attaching the two pole segments 21*a* and 21*b* together (Pole segment 21*a* has inner threads, which are not shown in FIG. 3.)

A pole 20 may be comprised of aluminum or of one or more other suitable materials. Furthermore, a pole 20 may include a cushioning grip comprised of rubber or of one or more other suitable materials. One skilled in the art will also recognize that suitable means other than threading may be utilized to attach the two pole segments 21 of the pole 20 and that a pole 20 may be comprised of only one, or more than two, pole segments 21.

Figure 4:
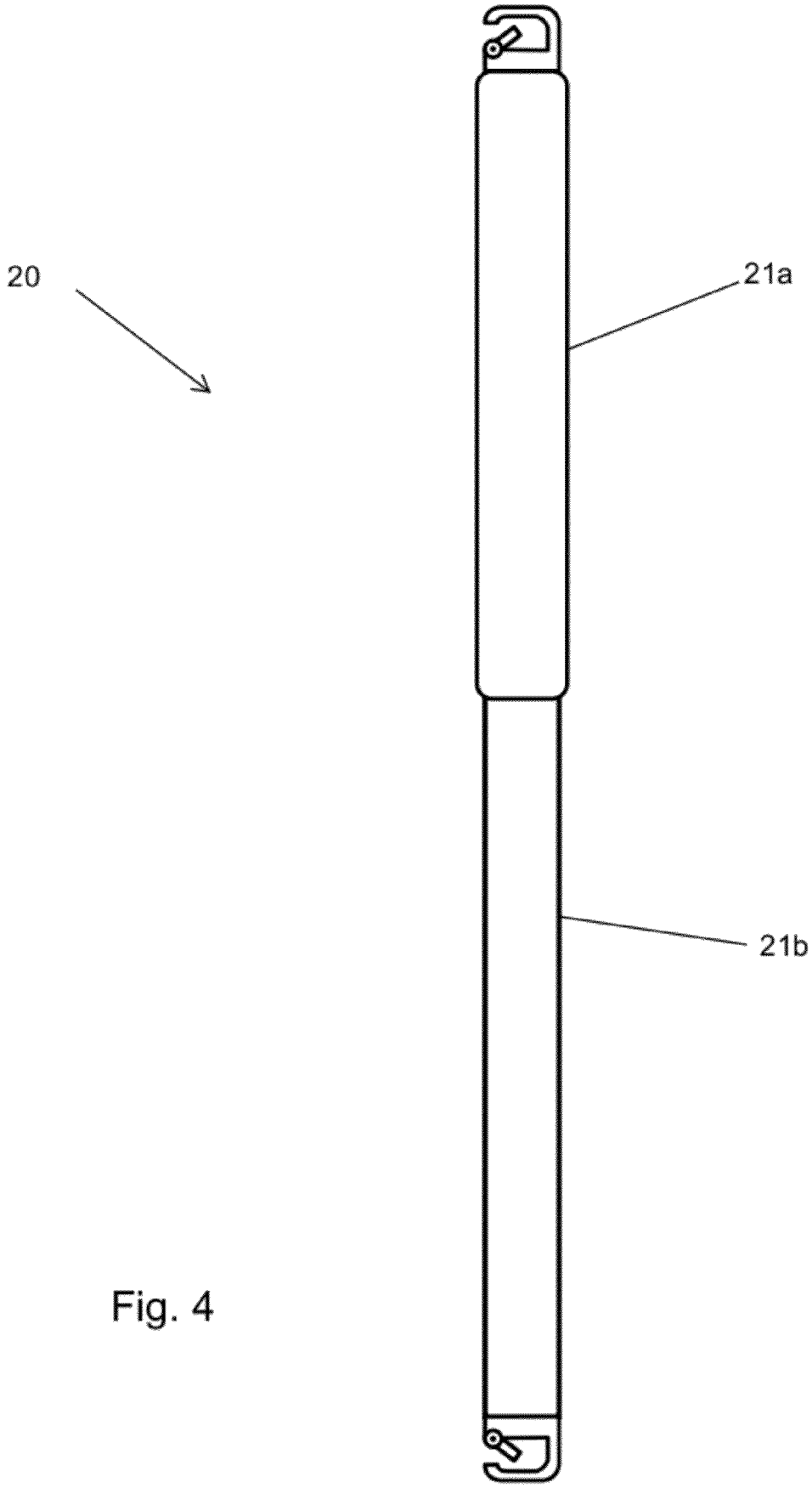
FIG. 4 depicts a pole component of an alternative embodiment of an exercise pole device in accordance with principles of the present invention.

FIG. 4 depicts a pole component of an alternative embodiment of an exercise pole device in accordance with principles of the present invention. As depicted in FIG. 4, a pole 20 is comprised of two pole segments 21*a* and 21*b* that are slideable, the latter within the former. Pole segment 21*b* may be retracted to be partially or entirely contained within pole segment 21*a*.

Figure 5:
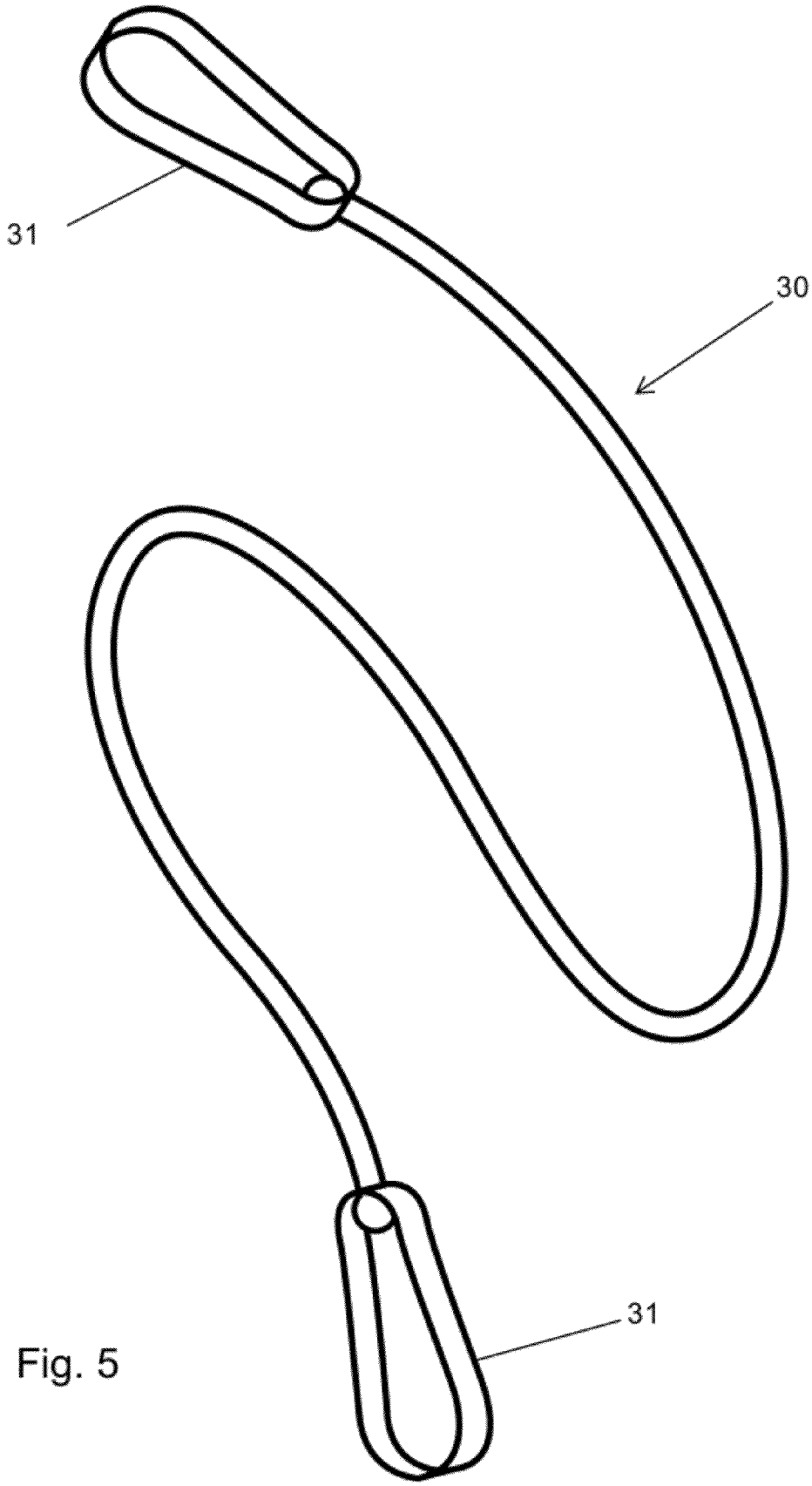
FIG. 5 depicts a resistance tubing component of the embodiment of the exercise pole device of FIG. 1 in accordance with principles of the present invention.

FIG. 5 depicts a resistance tubing component of the embodiment of the exercise pole device of FIG. 1 in accordance with principles of the present invention. As depicted in FIG. 5, each end of a resistance tubing component 30 includes a loop 31 for allowing attachment or securing of the resistance tubing component 30 to an end component 40 by being contained by the hole and opening linkage of the end component. A resistance tubing component 30 has a particular level of resistance, and may have a particular color or color combination corresponding to the level of resistance. For example, low, medium and high resistance tubing may be yellow, green and red, respectively.

Figure 6:
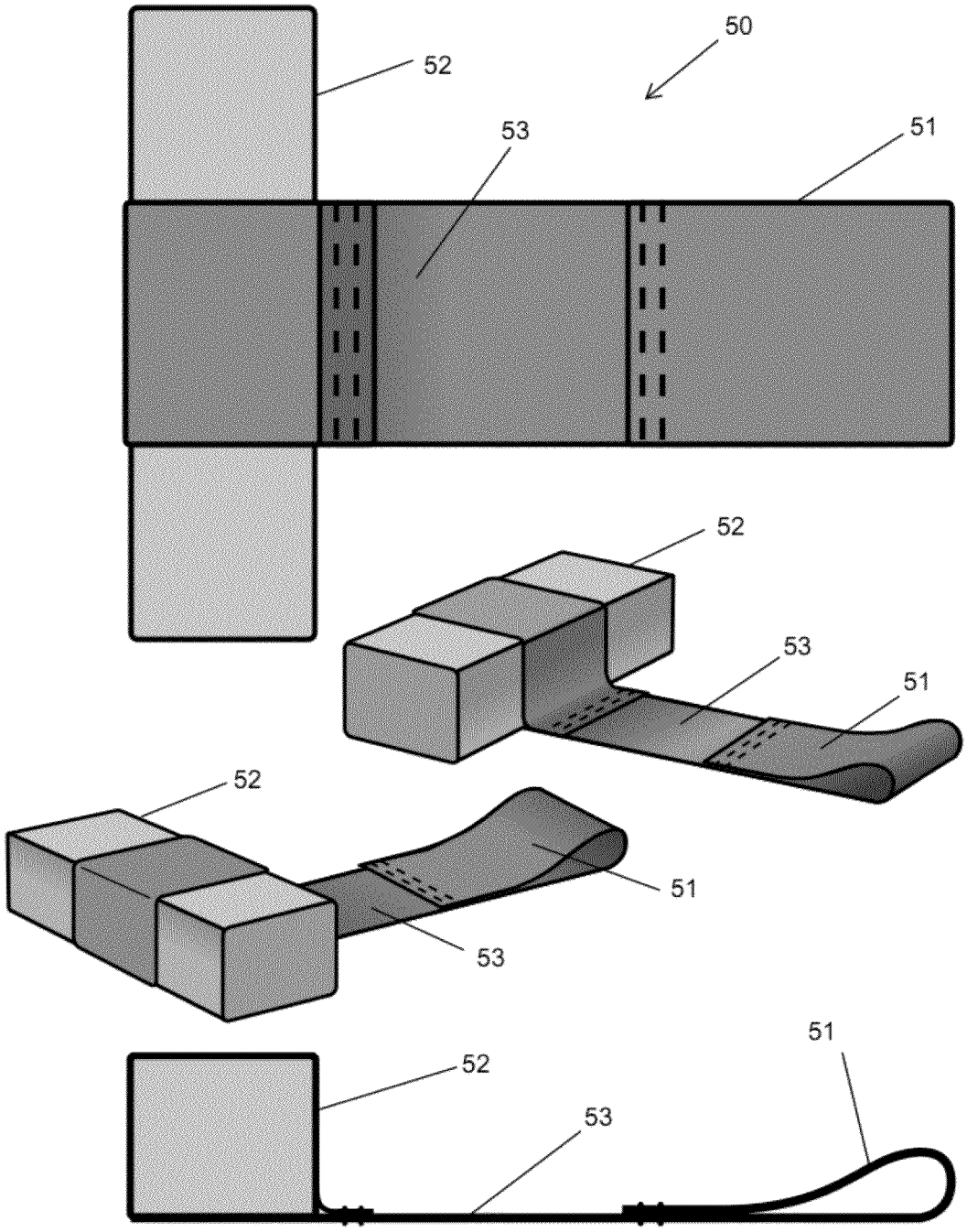
FIG. 6 depicts different views of an anchor component of the embodiment of the exercise pole device of FIG. 1 in accordance with principles of the present invention.

FIG. 6 depicts four different views of an anchor component of the embodiment of the exercise pole device of FIG. 1 in accordance with principles of the present invention. As depicted in FIG. 6, an anchor component 50 is comprised of a strap component 53 which may be made of nylon or other suitable material and includes a loop 51 for attachment to a resistance tubing component 30, and a block component 52 comprised of plastic or other suitable material. An anchor component 50 may be placed between a door and a door frame in order to anchor an exercise pole device 10.

One skilled in the art will recognize that an end of a resistance tubing component 30 may comprise suitable means other than a loop 31 for allowing attachment or securing to an end component 40. Similarly, an anchor component 50 may comprise suitable means other than a loop 51 for attachment of the anchor component 50 to a resistance tubing component 30.

Figure 7A:
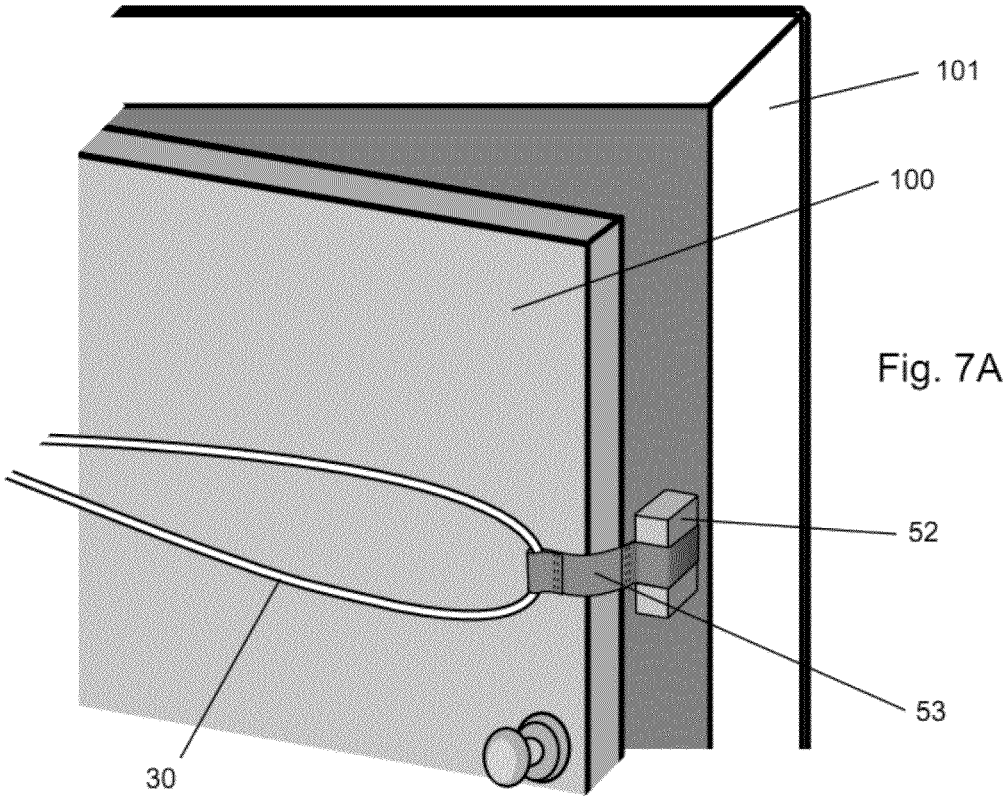
FIG. 7A depicts the placement of the anchor component of FIG. 6 between a door and a doorframe while the door is open.
Figure 7B:
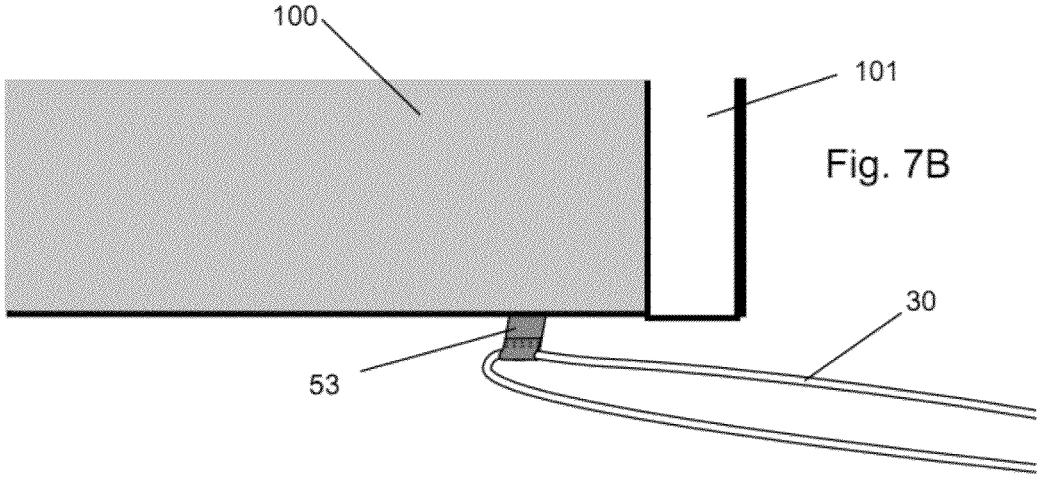
FIG. 7B depicts the placement of an anchor component of FIG. 6 between a door and a floor while the door is closed.

FIG. 7A depicts the placement of an anchor component 50 between a door and a doorframe while the door is open. The strap component 53 of the anchor component 50 runs across the thickness of the door 100 and the block component 52 is placed between the door 100 and the doorframe 101 on the side of the door opposite to the resistance tubing component 30. After placing the anchor component 50 as described, the door is closed to secure the anchor component between the door 100 and the doorframe 101. An anchor component 50 may also be placed along the top, side, or bottom (FIG. 7B) of a door 100 depending upon the desired physical exercise procedure.

One skilled in the art will recognize that a block component 52 may have alternate shapes other than the substantially rectangular shape depicted in FIG. 6, and that any suitable shape that will prevent the anchor component 50 from being pulled away from the door and doorframe may be used.

The invention thus permits the performance of physical exercise procedures for variety of muscle groups with a portable and easy to use device. Some examples of physical exercise procedures that may be performed using an exercise pole device are Transverse Abdominal Twists, Multi Transverse Abdominal Twists, Sprinkler Twists, Transverse Twisting Lunges, Standing Bicep Curls, Kneeling Shoulder Presses, Seated Rows, Standing Straight Front Latt-Pull Down, Standing Straight Backwards Latt-Pull Down, Standing Chest Press, Standing One Arm Overhead Tricep Extensions, Standing One Arm Bicep Curls, and Standing One Arm Back Flys. Other examples physical exercise procedures that may be performed using an exercise pole device are squat, abdominal curl, lateral bend, standing chest press, standing row, standing curl, standing tricep extension, and standing shoulder press. The methods for performing each of these physical exercise procedures are listed below.

Transverse Abdominal Twists

Muscles Worked: Transverse Abdominis, Chest, Back, Inner Core.

Figure 8:
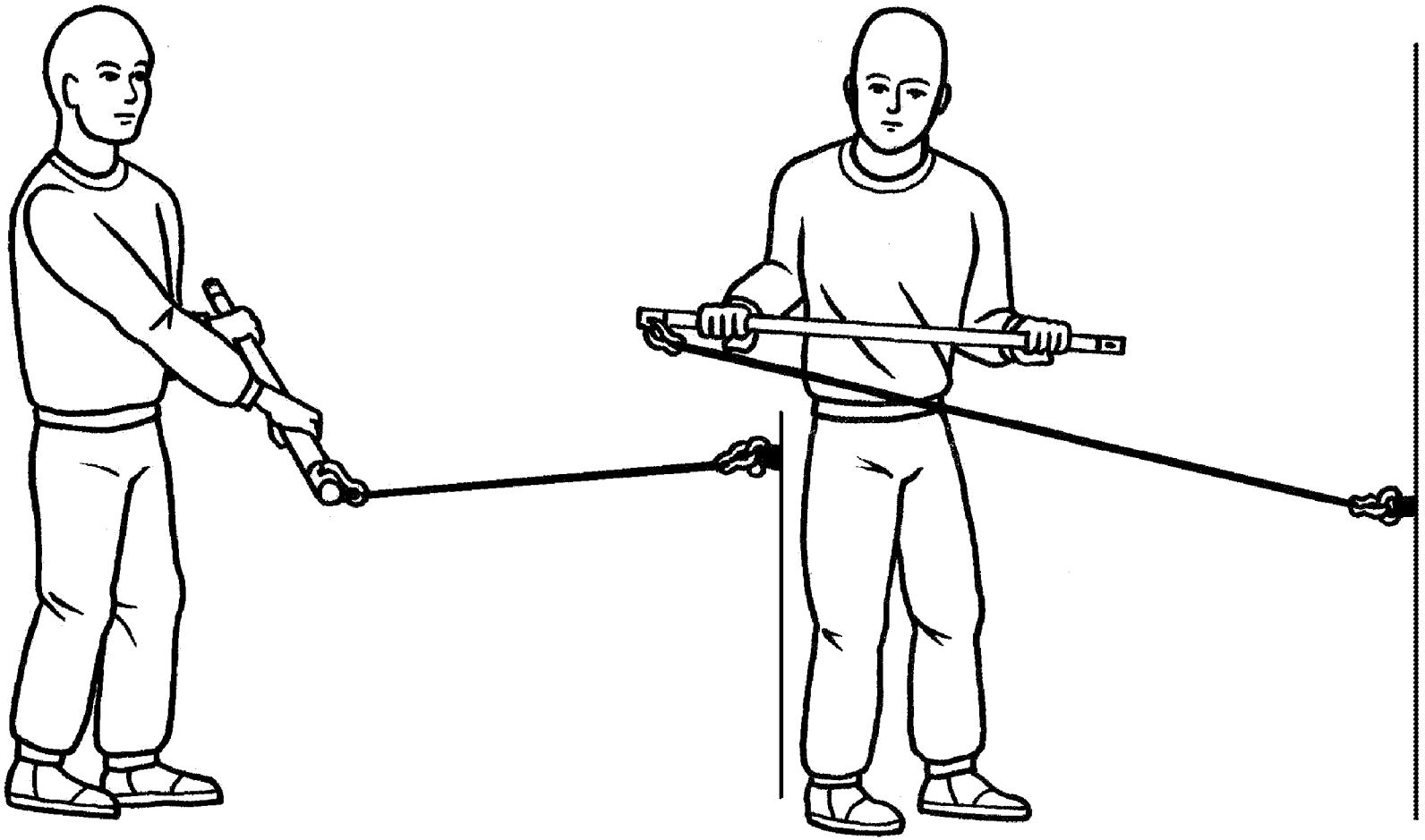
FIGS. 8-18 depict an exercise pole device being used in various physical exercises.

FIG. 8. Assemble the exercise pole device in open-end configuration (see FIG. 1) and attach the anchor component at hip height to the door. Grab the exercise pole device with both hands using an overhand grip. Make sure the hands are about shoulder width apart. In a staggered stance, rotate the trunk of your body about 45 degrees. Pull with the hand closest to the door attachment end of the exercise pole device and push with the other hand. Complete 12-15 trunk twists and repeat on the other side.

Multi Transverse Abdominal Twists

Muscles Worked: Muscles Worked: Transverse Abdominis, Chest, Back, Inner Core, Internal Obliques, External Obliques.

Figure 9:
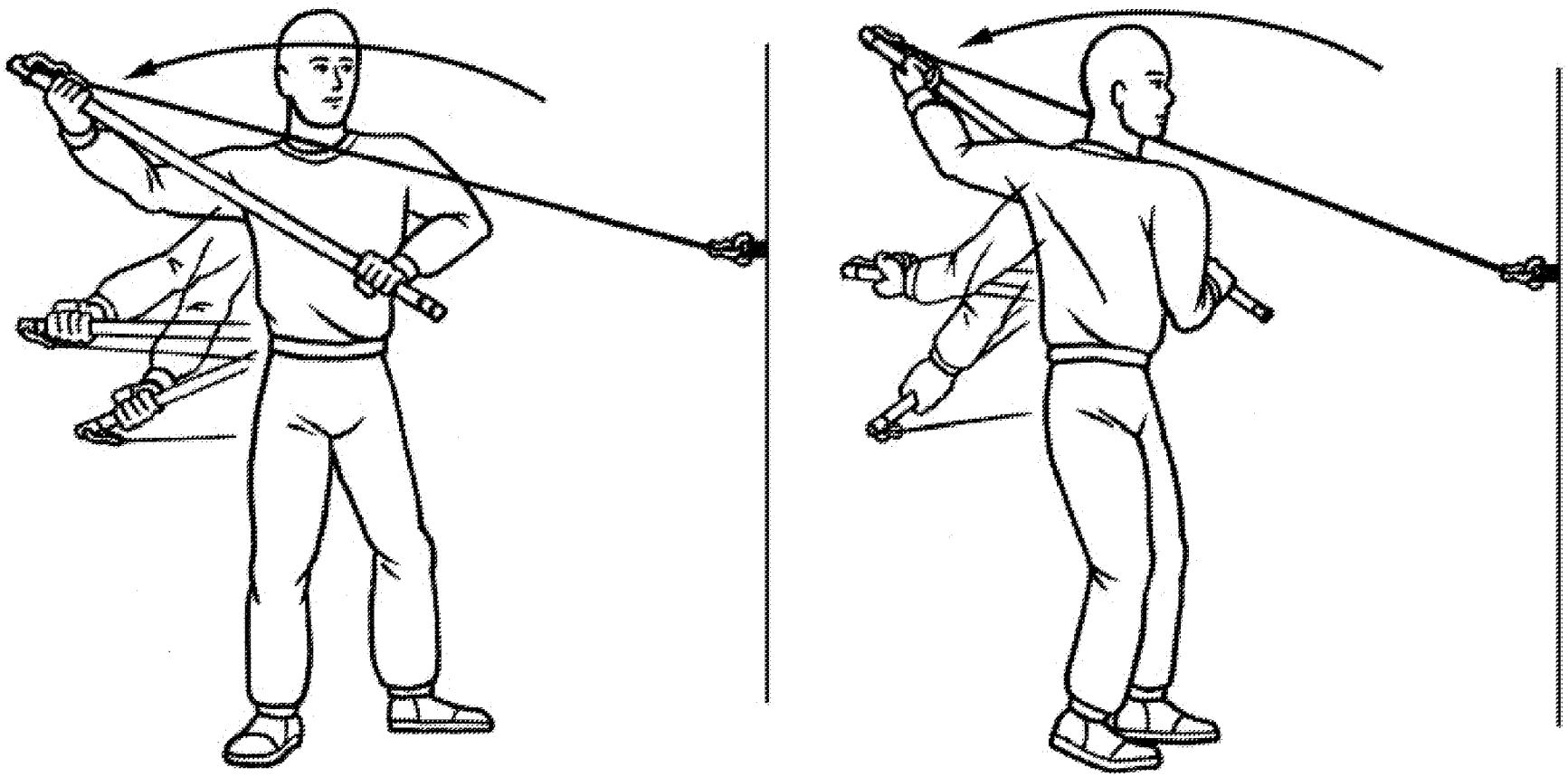

FIG. 9. Assemble the exercise pole device in open-end configuration (see FIG. 1) and attach the anchor component at hip height to the door. Grab the exercise pole device with both hands with an overhand grip. Make sure the hands are about shoulder width apart. In a staggered stance, rotate the trunk of your body about 45 degrees. Pull with the hand closest to the door attachment end of the bar and push with the other hand. As you rotate, take the hand closest to the attaching end, up to shoulder height, then to waist height, then to knee height. Repeat again, starting at shoulder height. Each 3 plains count as 1 repetition. Complete a total of 12-15 repetitions then repeat on the other side.

Sprinkler Twists

Muscles Worked: Transverse Abdominis, Gluteus Maximus, Gluteus Medius, Back, Inner Core, Internal Obliques, External Obliques.

Figure 10:
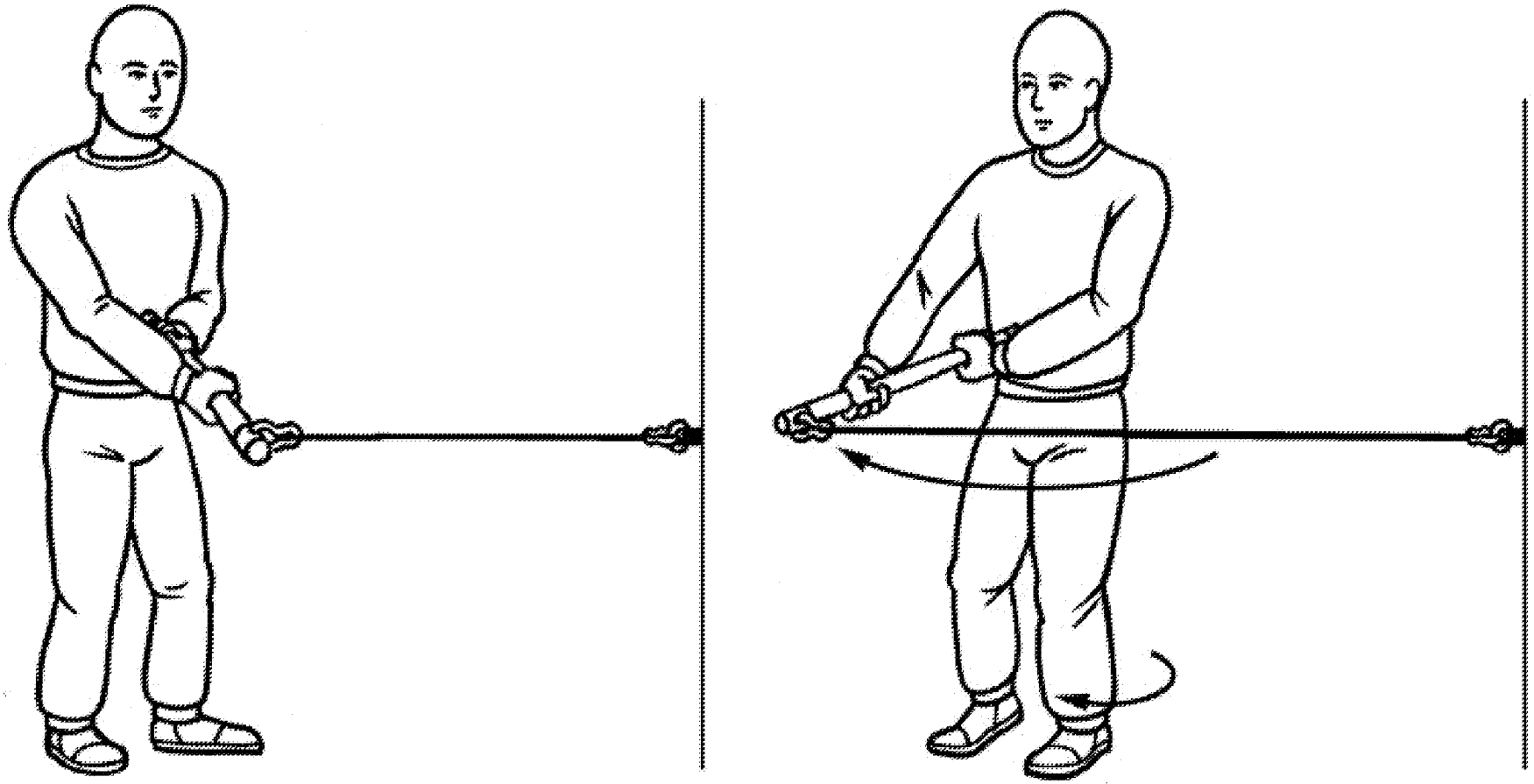

See FIG. 10. Assemble the exercise pole device in open-end configuration (see FIG. 1) and attach the anchor component at hip height to the door. Position the non-attached end of the pole at mid-body, just above the navel, with an overhand grip. With the other hand, relatively straight, give the pole an underhand grip towards the other end. With feet about shoulder width apart, rotate the trunk about 45 degrees to your right. Return to the starting position and repeat for a total of 12-15 repetitions. Reverse the hand positions and repeat the exercise, rotating to your left.

Transverse Twisting Lunges

Muscles Worked: Quadriceps, Hamstrings, Gluteus Maximus, Chest, Back, Inner Core, Internal Obliques, External Obliques.

Figure 11:
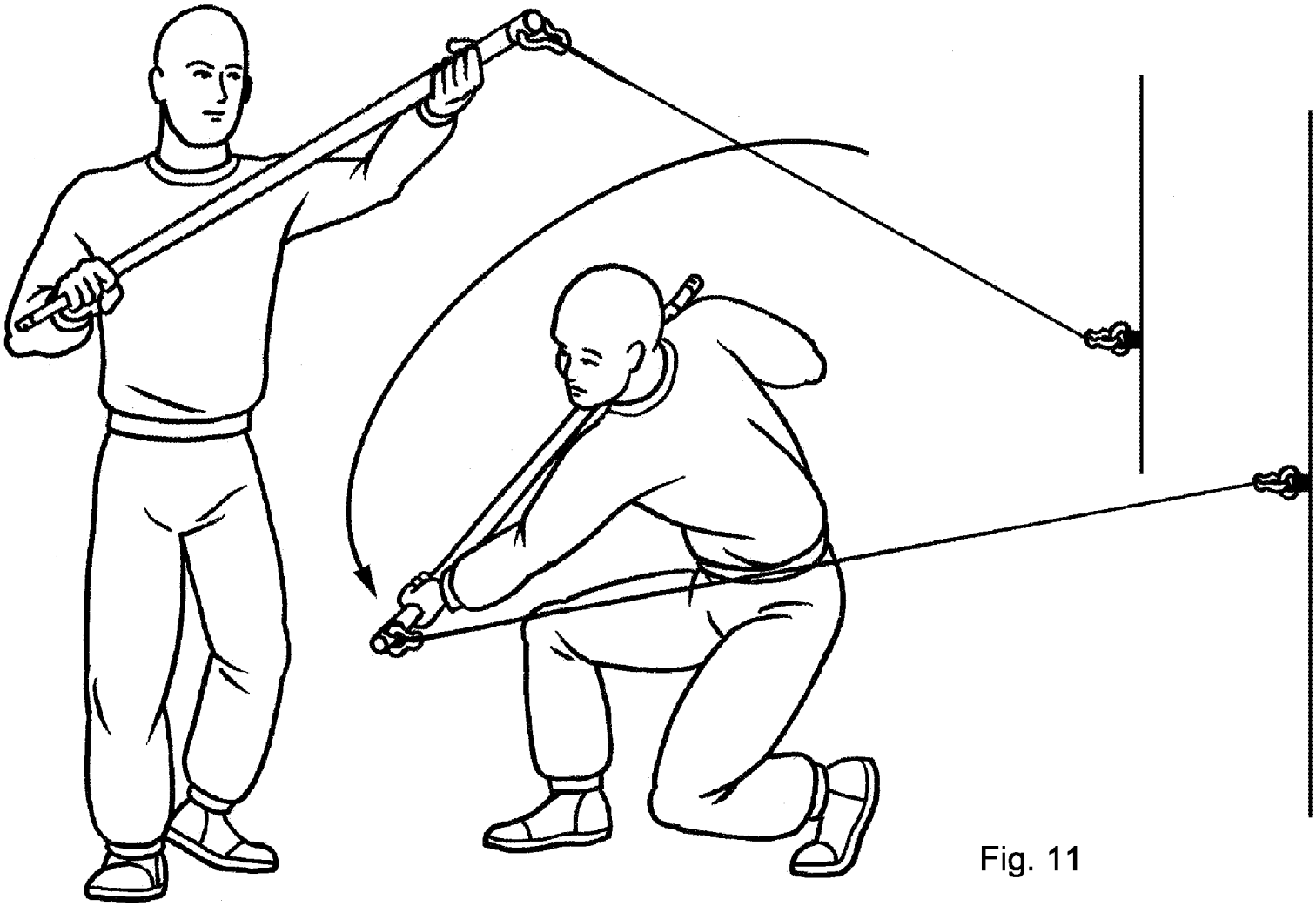

See FIG. 11. Assemble the exercise pole device in open-end configuration (see FIG. 1) and attach the anchor component at the highest position on the door. Take a left hand (underhand) grip to the pole close to the attached end. With the right hand, grip the pole with an overhand grip towards the other end. With feet about shoulder width apart, stand with the left shoulder facing the door. Rotate your trunk about 90 degrees to your right and follow through by taking the right leg into a 90 degree rotation and 90 degree flexion at the knee. Simultaneously, rotate the left leg 90 degrees, taking the right knee into a 90 degree bend. Rotate both legs and trunk simultaneously back up into the starting position. Repeat this movement about 12-15 times. Reverse pole hand grip and stance and repeat on the other side of the body.

Standing Bicep Curls

Muscles Worked: Biceps.

Figure 12:
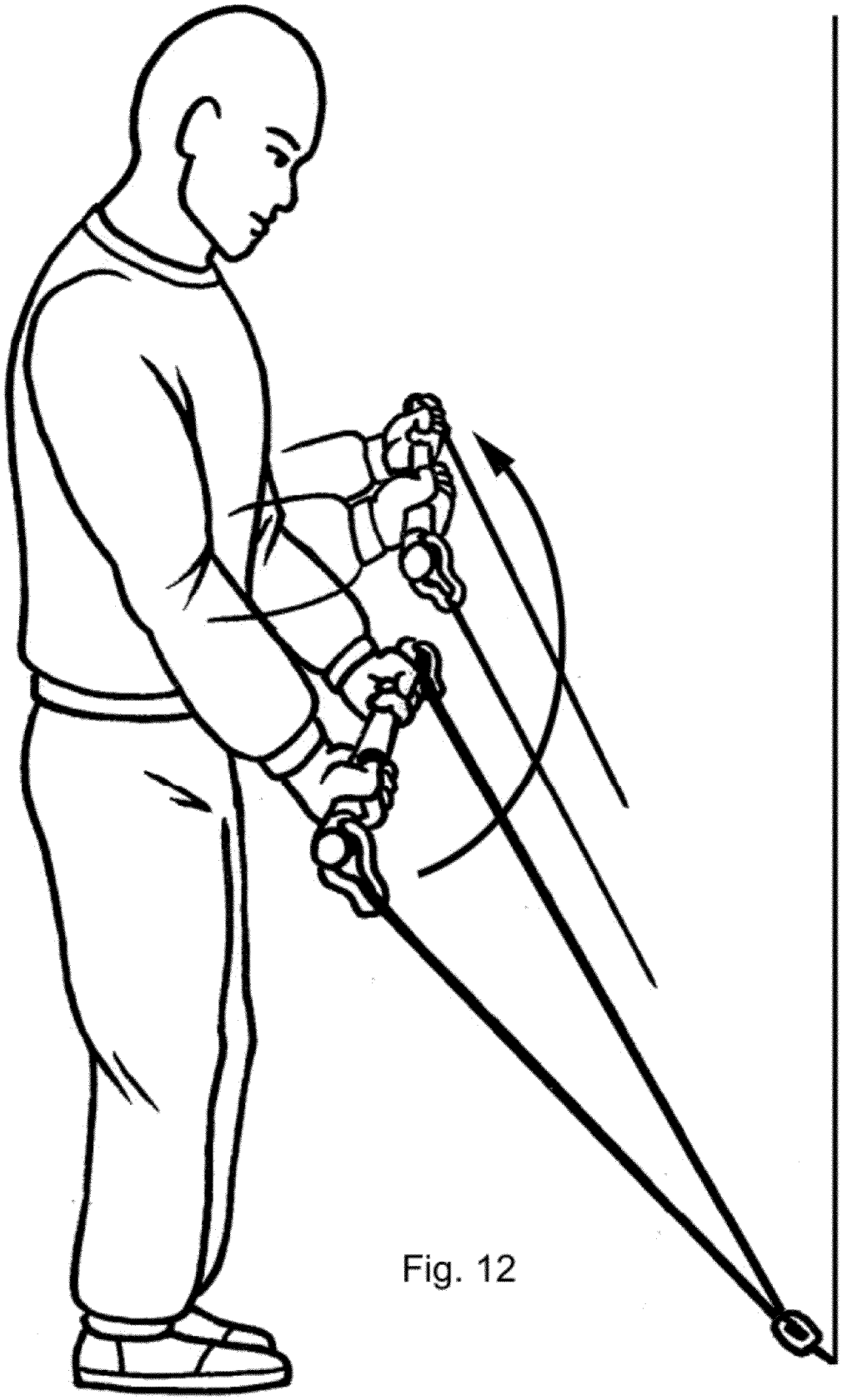

See FIG. 12. Assemble the exercise pole device in open-end configuration (see FIG. 1) and attach the anchor component at the lowest position on the door. Grip the exercise pole device with an underhand grip, about shoulder width apart. Stand a foot away from the door. Face the door, with your arms down. Bend the elbows up into a 135 degree angle. Return to the low start position and repeat for a total of 12-15 repetitions.

Kneeling Shoulder Presses

Muscles Worked: Shoulders (Medial and Front Deltoids).

Figure 13B:
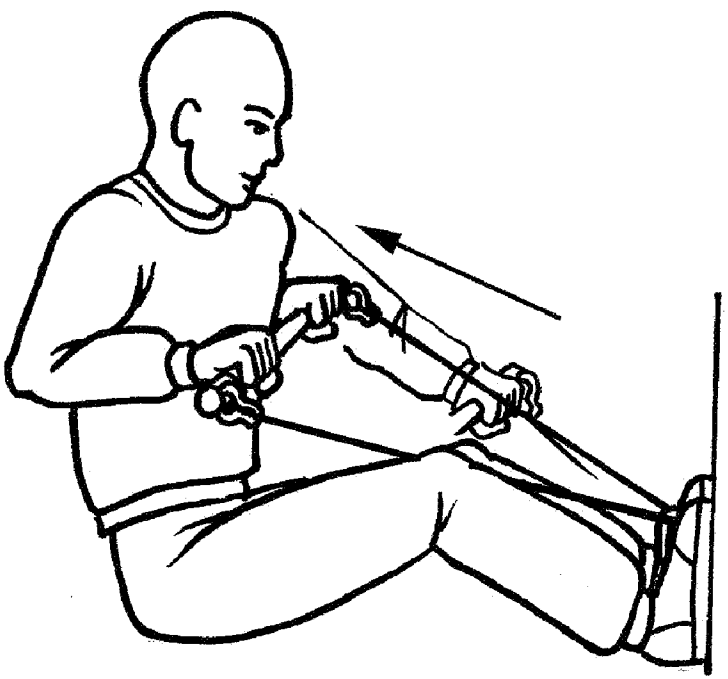
Figure 13A:
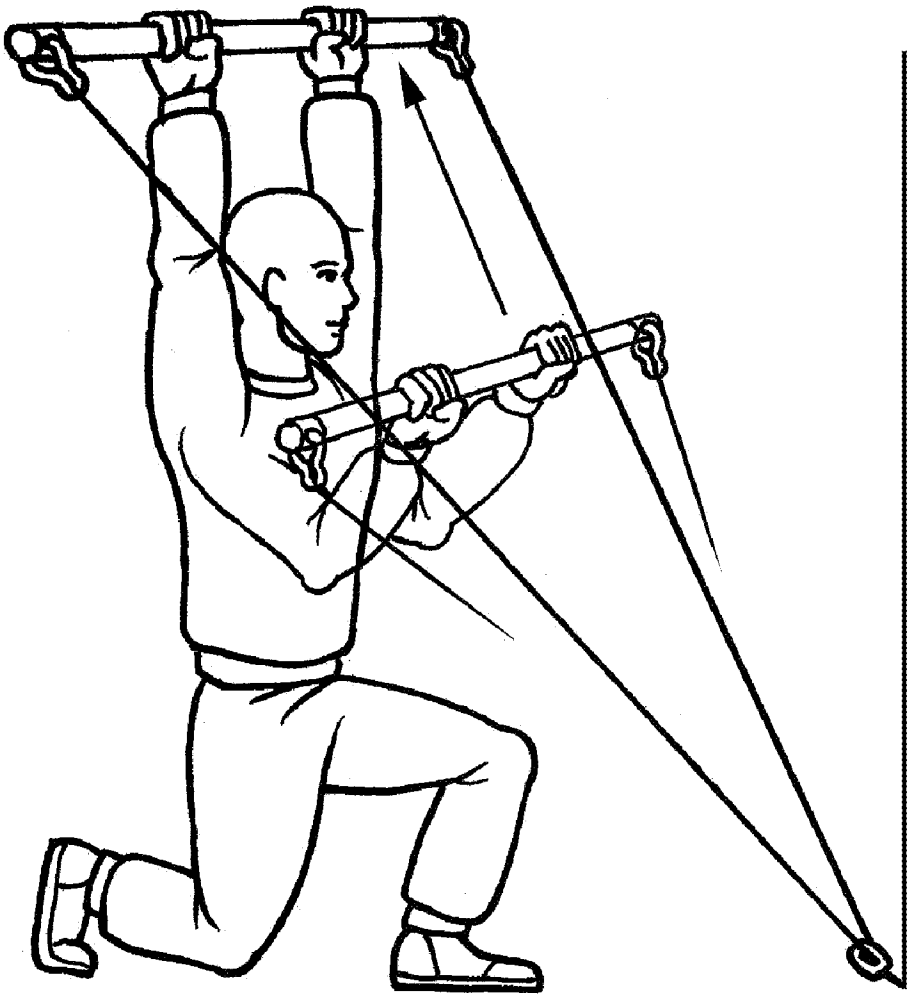

See FIG. 13A. Assemble the exercise pole device in closed-end configuration (see FIG. 2) and attach the anchor component at the lowest position on the door. Give the exercise pole device an overhand grip, just wider than shoulder width apart. Kneel on one 13B knee about a foot away from the door. Facing the door, start with the pole close to the body, at shoulder height. Extending at the elbows, raise the pole overhead until the elbows are completely straight. Return to the lower starting position and repeat movement for a total of 12-15 repetitions.

Seated Rows

Muscles Worked: Back (Latissimus Dorsi, Rhomboids) Rear Deltoids.

See FIG. 13B. Assemble the exercise pole device in closed-end configuration (see FIG. 2) and attach the anchor component at the lowest position on the door. Sit on the floor, facing the door with your feet about shoulder width apart, and up against the door. Give the exercise pole device an overhand grip, just wider than shoulder width apart. Start by holding the pole with the arms fully extended. Bend the elbows about 90 degrees, bringing the pole in towards the lower aspect of your chest. Return the arms to their starting extended position and repeat. Complete a total of 12-15 repetitions.

Standing Straight Front Latt-Pull Down

Muscles Worked: Latissimus Dorsi, Triceps.

Figure 14B:
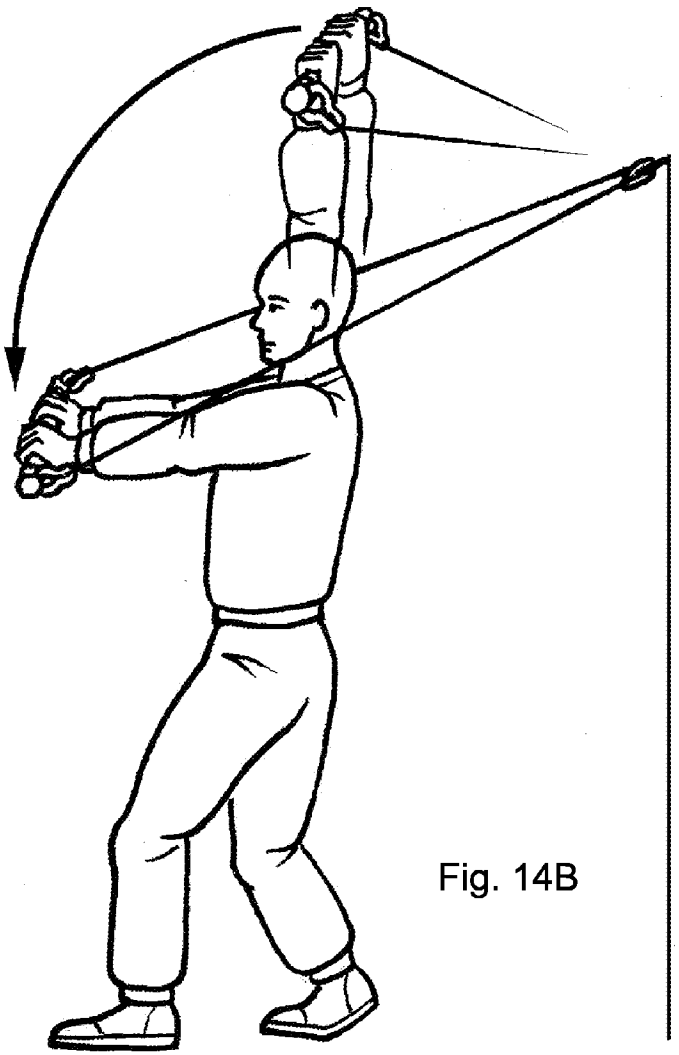
Figure 14A:
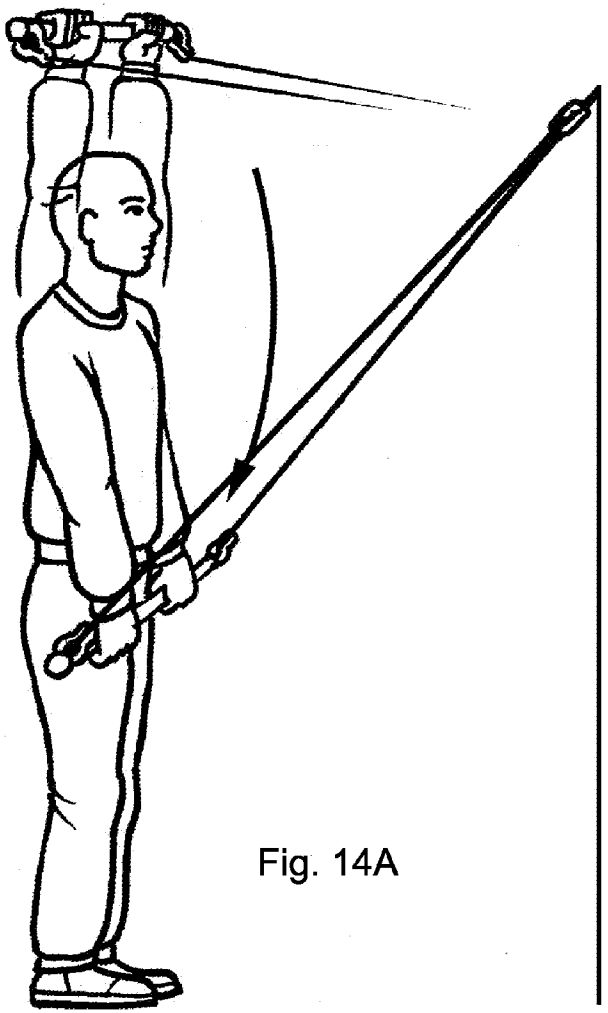

See FIG. 14A. Assemble the exercise pole device in closed-end configuration (see FIG. 2) and attach the anchor component at the highest position on the door. Step about a foot away from the door and face the door. Grip pole with both hands with an overhand grip, spacing the hands about shoulder width apart. Draw the pole in close to the body with both arms down and straight. Keeping the elbows straight, raise the pole to the height of your forehead, and then back down into the starting position. Repeat this movement for 12-15 repetitions.

Standing Straight Backwards Latt-Pull Down

Muscles Worked: Latissimus Dorsi, Triceps.

See FIG. 14B. Assemble the exercise pole device in closed-end configuration (see FIG. 2) and attach the anchor component at the highest position on the door. Grip pole with both hands with an overhand grip, spacing the hands about shoulder width apart. Stand about a foot away from the door with your back facing the door. Draw the pole in close to the body with both arms down and straight. Keeping the elbows straight, raise the pole to the height of your forehead, and then back down into the starting position. Repeat this movement for 12-15 repetitions.

Standing Chest Press

Muscles Worked: Chest (Pectoralis Major and Minor) Triceps, Front Deltoids.

Figure 15:
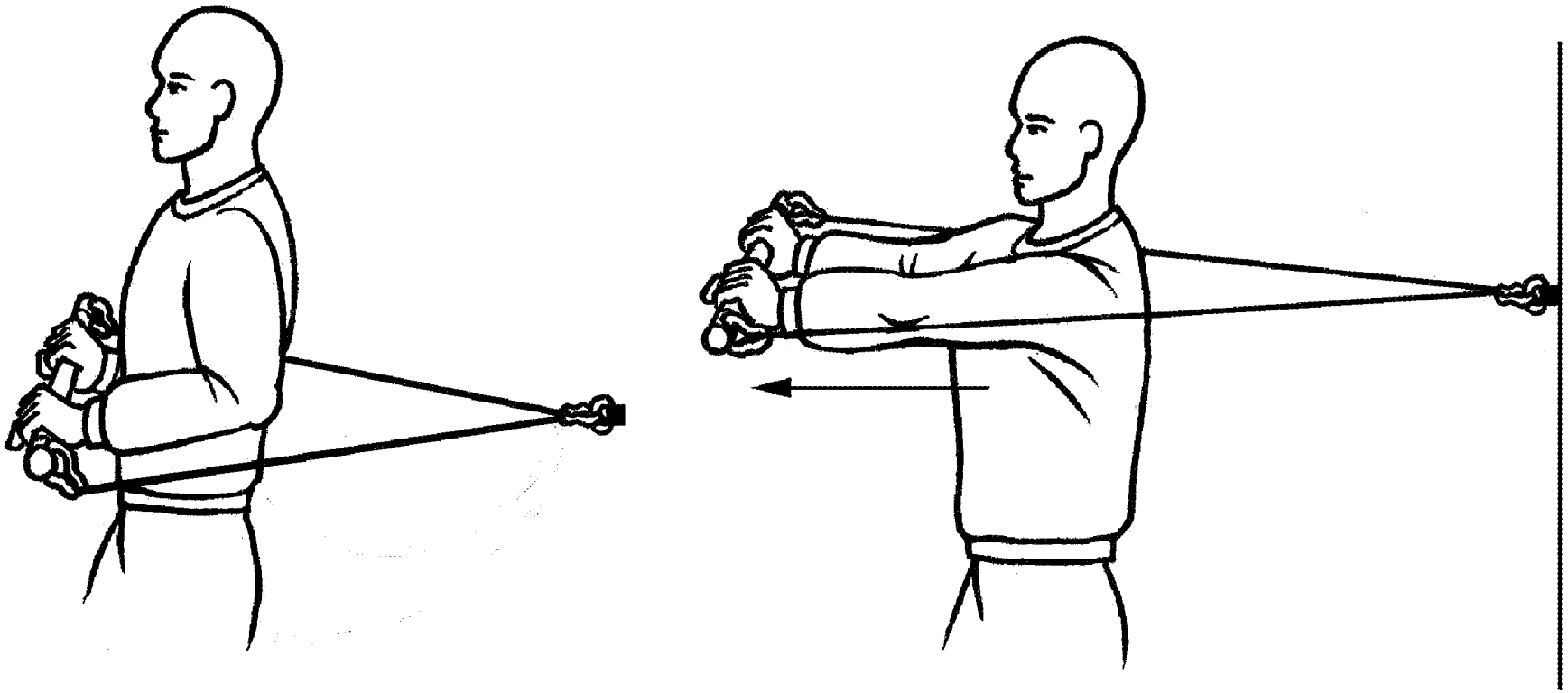

See FIG. 15. Assemble the exercise pole device in closed-end configuration (see FIG. 2) and attach the anchor component to the door at chest level. Grip pole with both hands with an overhand grip, spacing the hands about shoulder width apart. Stand about a foot away from the door with your back facing the door. Hold the pole at chest levels with both arms straight. Draw the pole into the chest by bending both elbows about 90 degrees. Extend the arms by pushing the pole back out to the starting position. Repeat this movement for 12-15 repetitions.

Exercise I: Standing One Arm Overhead Tricep Extensions

Muscles Worked: Triceps.

Figure 16:
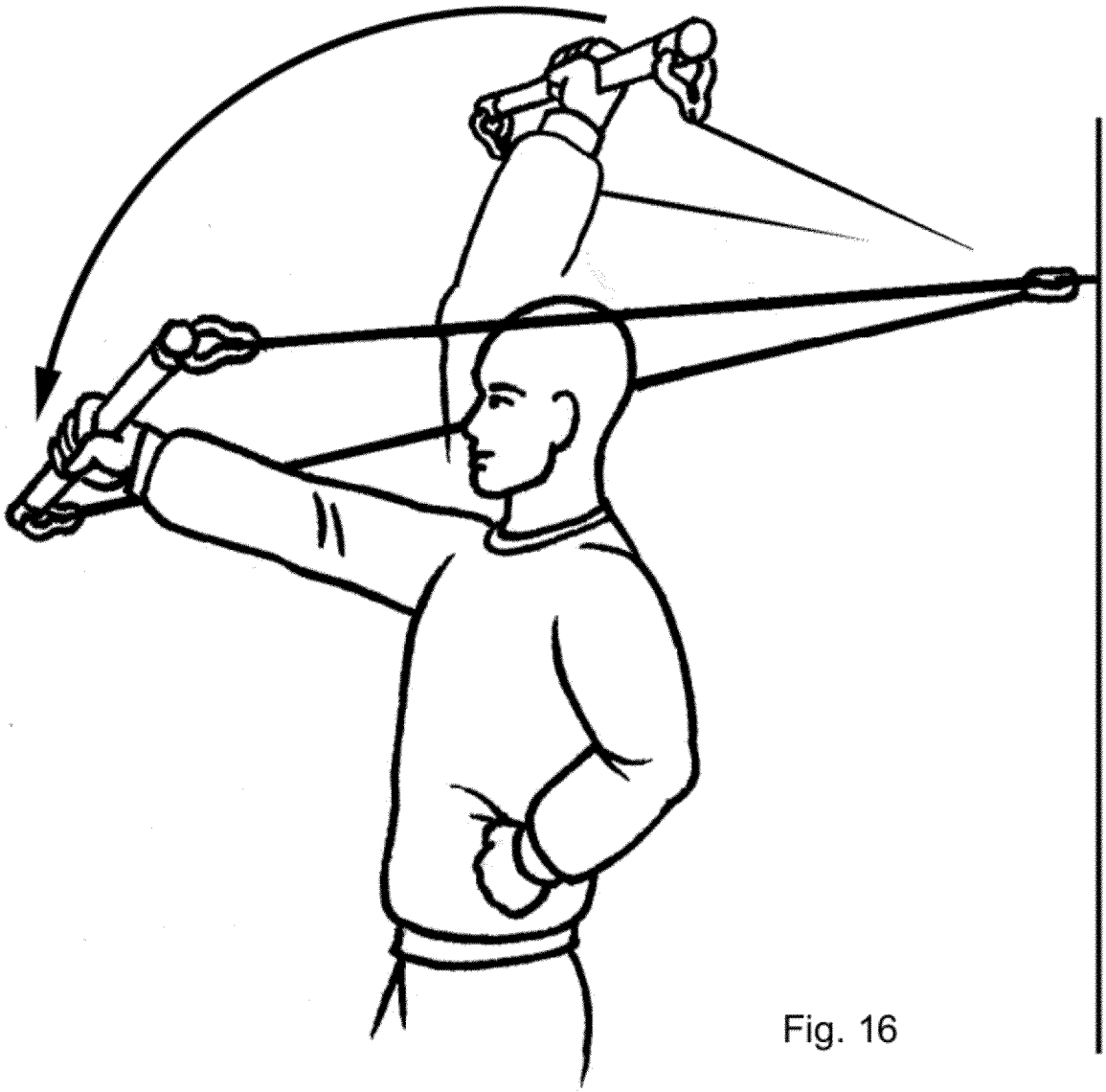

See FIG. 16. Assemble the exercise pole device in closed-end configuration (see FIG. 2) and attach the anchor component at the highest position on the door. Grip the pole with 1 hand in the middle of the pole with an overhand grip. Stand about a foot away from the door with your back facing the door. With your arm straight, hold the pole to the height of your forehead. Bending your elbow, take the pole back towards your forehead until the elbow is in 90 degree flexion. Push the pole forward until the arm is back into the starting position. Repeat this movement for 12-15 repetitions before switching to the other arm.

Exercise J: Standing One Arm Bicep Curls

Muscles Worked: Biceps.

Figure 17:
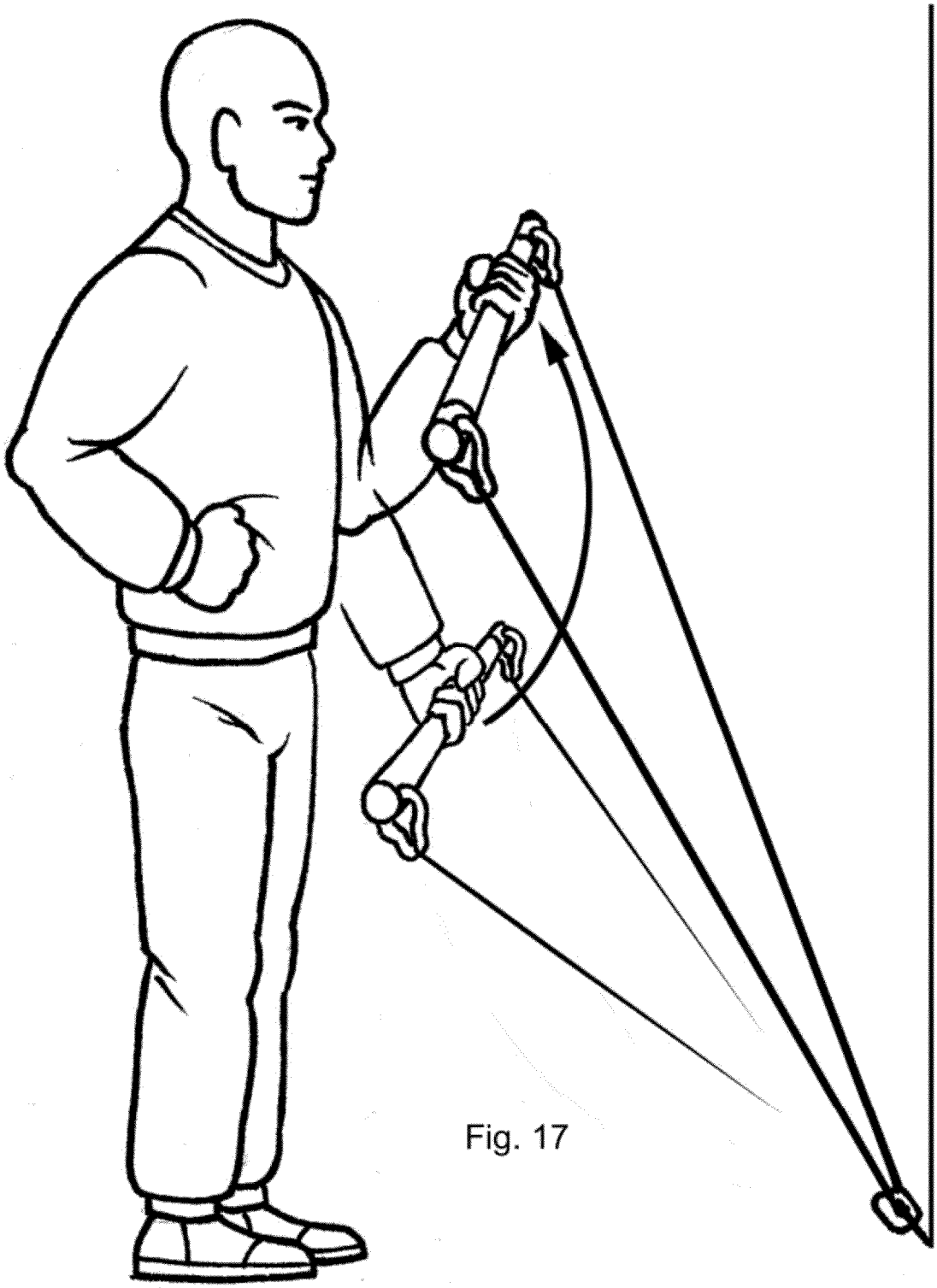

See FIG. 17. Assemble the exercise pole device in closed-end configuration (see FIG. 2) and attach the anchor component at the lowest position on the door. Grip the exercise pole device with 1 hand in the middle of the pole with an underhand grip. Stand about a foot away from the door. Facing the door, with your arm down, close to the body, bend the elbow up into a 135 degree angle. Return to the low start position and repeat for a total of 12-15 repetitions before switching to the other arm.

Exercise K: Standing One Arm Back Flys

Muscles Worked: Back (Rhomboids) Rear Deltoids, Triceps.

Figure 18:
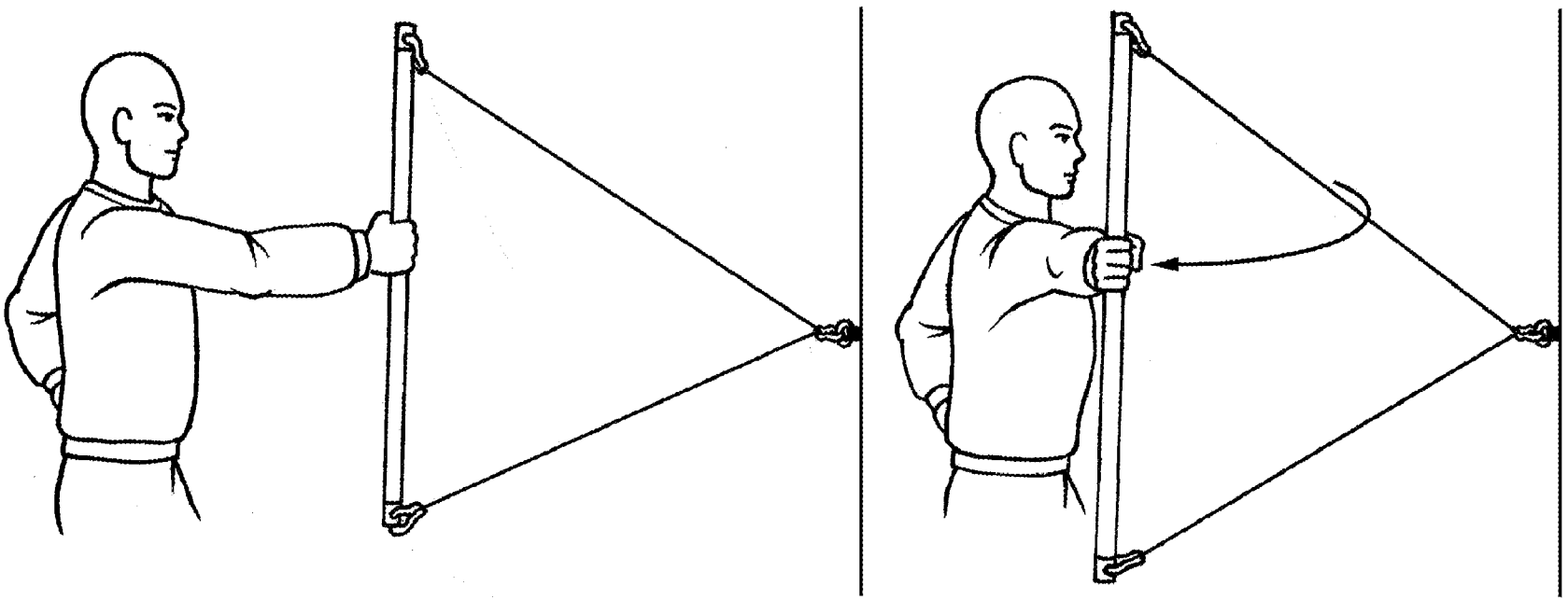

See FIG. 18. Assemble the exercise pole device in closed-end configuration (see FIG. 2) and attach the anchor component to the door at chest level. Grip the pole with an overhand grip at mid pole. Stand about a foot away from the door facing the door. Start with the arm straight at chest level, extended towards the door. With the pole held vertically and the elbow straight, extend the pole backwards, about 90 degrees until the arm is aligned with the body. Bring the pole back into the starting position. Repeat this movement for 12-15 repetitions before switching to the other arm.

Other examples of physical exercise procedures that may be performed using an exercise pole device are squat, abdominal curl, lateral bend, standing chest press, standing row, standing curl, standing tricep extension, and standing shoulder press. The methods for performing each of these physical exercise procedures are listed below.

Squat. This physical exercise procedure works various leg muscles (quadriceps, hamstrings, and gluteus) and is performed using an exercise pole device in closed end configuration. Holding the pole with both hands, place the middle of both feet evenly on the resistance tubing (about hip width apart). Lift the pole overhead and place on the shoulders. Stabilize the pole on the shoulders by holding the pole at both ends. Begin to bend the knees and squat as if taking a seat. Continue to squat down until you reach a 90 degree angle at the knees. Come back up to the starting position. Repeat this movement for a total of 15-20 repetitions.

Abdominal Curl. This physical exercise procedure works the abdominal muscles (rectus abdominus) and is performed using an exercise pole device in closed end configuration with the resistance tubing through the loop of the anchor. Anchor the exercise pole device to a door by placing the anchor at the top of the door, so that the pole hangs device on the door. Give the pole an underhand grip with both hands (about a foot apart from each other). With the pole still gripped by the hands, back away from the door (about 3 feet) and kneel on both knees, such that the knees are perpendicular to floor. Enclose the elbows towards each other and place the forehead in between the two elbows. With the forehead and elbows fixed, curl the trunk by taking the elbows towards the hips and squeeze the abdominal muscles. Take this movement to the end of range and return to the starting position. Repeat this movement for a total of 20-30 repetitions.

Lateral Bend. This physical exercise procedure works the core muscles (Obliques) and is performed using an exercise pole device in closed end configuration with the resistance tubing through the loop of the anchor. Anchor the exercise pole device to a door by placing the anchor at the bottom of the door. Pick up the pole with one hand and turn sideways perpendicular to the door. Step away from the door so that the foot closest to the door is 3-4 feet away from door. Place the foot furthest away from the door further out creating a wide stance (feet being 3-4 feet apart). Bend both knees and place the free hand behind the head with the palm facing inward. With fixed bent knees, begin to bend at the waist towards the door. Move to the end of range then return to the starting position. Repeat this movement for a total of 15-20 repetitions. Repeat this movement on the opposite side facing the opposite direction.

Standing Chest Press. This physical exercise procedure works the chest muscles (pectoralis) and is performed using an exercise pole device in closed end configuration with the resistance tubing through the loop of the anchor. Anchor the exercise pole device a to door by placing the anchor at chest level height along the vertical length of the side of the door. Raise the pole overhead and position yourself between the resistance tubing and the pole with the back faced towards the door. Step 3-4 feet away from the door and place one foot in front of the other (staggered stance) until the feet are 2.5-3 feet apart. With an overhand grip on the pole, proceed to push the pole out (at chest height) away from the door. Bring the pole back towards the chest by bending the elbows to 90 degrees. Repeat this movement for a total of 12-20 repetitions.

Standing Row. This physical exercise procedure works various back muscles (rhomboids, rear deltoids, mid-trapezius) and is performed using an exercise pole device in closed end configuration with the resistance tubing through the loop of the anchor. Anchor the exercise pole device to a door by placing the anchor at chest level height along the vertical length of side of the door. With both hands (a little wider than shoulder width), grab the pole with an overhand grip. Facing the door, step back 3-4 feet away from the door. Assume a wide staggered stance by taking one leg further back away from the door. Stabilize your posture by putting a bend in both knees. Bring the pole to chest level. Starting with the arms straight, began to pull the pole in towards your chest (pulling the shoulder blades towards the center line of back.) Pull to the end of the range and return to the straight arm starting position. Repeat this movement for a total of 15-20 repetitions.

Standing Curl. This physical exercise procedure works the arm muscles (biceps) and is performed using an exercise pole device in closed end configuration with the resistance tubing through the loop of the anchor. Anchor the exercise pole device to a door by placing the anchor at the bottom of the door. With both hands, grip the pole with an underhand grip (about shoulder width apart). Facing the door, step back away from the door (about a foot). With a slight bend in both knees, start by bending the elbows to curl the pole towards the chest. Curl to the end of range (full bend at elbows). Return to the starting position and repeat movement for a total of 15-20 repetitions.

Standing Tricep Extension. This physical exercise procedure works the arm muscles (triceps) and is performed using an exercise pole device in closed end configuration with the resistance tubing through the loop of the anchor. Anchor the exercise pole device to a door by placing the anchor at the top of the door, so that the pole hangs on the door. Give the pole device an overhand grip with both hands (about shoulder width apart). With the pole gripped by the hands, back away from the door (about 1 foot). Bend both knees slightly. Start with the arms to the sides with the elbows straight (180 degrees). Bending at the elbows only, allow the resistance tubing to raise the arms until each elbow is at a 90-degree angle. Return to the starting position. Repeat movement for a total of 15-20 repetitions.

Standing Shoulder Press. This physical exercise procedure works the shoulder muscles (anterior and medial deltoids) and is performed using an exercise pole device in closed end configuration with the resistance tubing through the loop of the anchor. Anchor the pole to a door by placing the anchor at the bottom of the door. With both hands, grip the pole with an overhand grip (slightly wider than shoulder width apart). Facing the door, step back away from door (about a foot). With a slight bend in both knees, start by fully extending both arms overhead until teach elbow is at a 180-degree angle. The arms should be aligned with ears. Still keeping the arms aligned with the ears, slowly allow the resistance tubing to pull the arms down to a 90-degree angle at the elbows. Return to the starting position. Repeat movement for a total of 15-20 repetitions.

One skilled in the art will recognize that there are also numerous physical exercise procedures that may be performed with an exercise pole device other than those listed herein.

While a particular form and use of the present invention has been described above, the invention is not limited to the specific arrangement of parts or manner of use described.

One skilled in the art understands that modifications to the construction and use of the present system may be made without departing from the scope of the invention.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention. This disclosure is intended to cover any adaptations or variations of the embodiments discussed herein.

What is claimed is:

1. A device for performing physical exercise, the device comprising:

(a) a substantially rigid elongated straight pole having a first end and a second end, wherein the substantially rigid straight elongated pole comprises a first end component fixed at the first end of the pole and a second end component fixed at the second end of the pole;

(b) an elastic band having a first and second end, wherein the first and second ends of the elastic band are directly attached to the first end component, such that the elastic band can provide resistance via the first end component; and (c) an anchor component attached to the elastic band;

wherein the anchor component comprises a strap component for attaching the anchor component to the elastic band and a block component for securing the anchor component between a closed door and the doorframe of the closed door.

2. The device of claim 1, wherein the elastic band comprises a first loop and a second loop disposed at the first and second ends of the elastic band for attaching the elastic band to the pole.

3. The device of claim 1, wherein the substantially rigid elongated straight pole is comprised of one or more retractable pole segments, wherein each retractable pole segment is slideable to be partially or entirely contained within another pole segment.

4. The device of claim 1, wherein the substantially rigid elongated straight pole is comprised of two or more pole segments, wherein each pole segment is attachable to one or two of the other pole segments.

5. The device of claim 4, wherein the pole segments have mating threads for attaching the pole segments to each other.

6. The device of claim 1, wherein the first end component is an integral part of the substantially rigid elongated straight pole.

7. The device of claim 1, wherein the strap component extends from one side of the closed door to the other side of the closed door.

8. A device for performing physical exercise, the device comprising:

(a) a substantially rigid elongated straight pole having a first end and a second end, wherein the substantially rigid elongated straight pole comprises a first end component fixed at the first end of the pole and a second end component fixed at the second end of the pole;

(b) an elastic band having a first and second end, wherein the first and second ends of the elastic band are directly attachable to the first end component, such that the elastic band can provide resistance via the first end component; and (c) an anchor component, wherein the anchor component is attachable to the elastic band;

wherein the anchor component comprises a strap component for attaching the anchor component to the elastic band and a block component for securing the anchor component between a closed door and the doorframe of the closed door.

9. The device of claim 8, wherein the elastic band comprises a first loop and a second loop disposed at the first and second ends of the elastic band for attaching the elastic band to the pole.

10. The device of claim 8, wherein the substantially rigid elongated straight pole is comprised of one or more retractable pole segments, wherein each retractable pole segment is slideable to be partially or entirely contained within another pole segment.

11. The device of claim 8, wherein the substantially rigid elongated straight pole is comprised of two or more pole segments, wherein each pole segment is attachable to one or two of the other pole segments.

12. The device of claim 11, wherein the pole segments have mating threads for attaching the pole segments to each other.

13. The device of claim 8, wherein the first end component is an integral part of the substantially rigid elongated straight pole.

14. The device of claim 8, wherein the strap component extends from one side of the closed door to the other side of the closed door.

15. A device for performing physical exercise, the device comprising:

(a) a substantially rigid elongated straight pole having a first end and a second end, wherein the substantially rigid elongated straight pole comprises a first end component disposed at the first end of the pole and a second end component disposed at the second end of the pole;

(b) an elastic band having a first and second end, wherein the first and second ends of the elastic band are directly attached to the first end component, such that the elastic band can provide resistance via the first end component; and (c) an anchor component attached to the elastic band, wherein the anchor component comprises a strap component for attaching the anchor component to the elastic band and a block component for securing the anchor component between a closed door and the doorframe of the closed door.

16. The device of claim 15, wherein the strap component extends from one side of the closed door to the other side of the closed door.

17. The device of claim 15, wherein the elastic band comprises a first loop and a second loop disposed at the first and second ends of the elastic band for attaching the elastic band to the pole.

18. The device of claim 15, wherein the first end component is an integral part of the substantially rigid elongated straight pole.

19. The device of claim 15, wherein the substantially rigid elongated straight pole is comprised of one or more retractable pole segments, wherein each retractable pole segment is slideable to be partially or entirely contained within another pole segment.

* * * * *